US006068147A

United States Patent [19]

Sheu

[11] Patent Number: 6,068,147

[45] Date of Patent: May 30, 2000

[54] AIR INTAKE AIDING PLATE FOR NIPPLES OF FEEDING BOTTLES

[76] Inventor: Miin-Shiou Sheu, 11F, No. 24-2, Alley 21, Lane 556, Sec.1, Chung shan Road, Chang Hua Hsien, Taiwan

[21] Appl. No.: 09/198,467

[22] Filed: Nov. 24, 1998

[51] Int. Cl.[7] ..... A61J 9/00; A61J 9/04

[52] U.S. Cl. ..... 215/11.5; 215/11.1

[58] Field of Search ..... 215/11.1, 11.4, 215/11.5

[56] References Cited

U.S. PATENT DOCUMENTS

| | | | |
|---|---|---|---|
| 347,018 | 8/1886 | Ware | 215/11.5 |
| 2,365,585 | 12/1944 | Paxman | 215/11.1 |
| 2,655,279 | 10/1953 | Wolf | 215/11.5 |
| 2,744,646 | 5/1956 | Blackstone | 215/11.1 |
| 2,968,414 | 1/1961 | Thomas | 215/11.1 |
| 3,355,047 | 11/1967 | De Sole | 215/11.1 |
| 4,940,152 | 7/1990 | Lin | 215/11.1 X |
| 5,211,298 | 5/1993 | Bloch | 215/11.5 X |
| 5,284,261 | 2/1994 | Zambuto | 215/11.5 |
| 5,678,710 | 10/1997 | Sheu | 215/11.1 X |
| 5,875,474 | 2/1999 | Gray | 215/11.1 |

FOREIGN PATENT DOCUMENTS

| | | | |
|---|---|---|---|
| 249200 | 5/1824 | Germany | 215/11.5 |

*Primary Examiner*—Sue A. Weaver
*Attorney, Agent, or Firm*—Dougherty & Troxell

[57] ABSTRACT

An air intake aiding plate structure for nipples of feeding bottles, in particular an aiding plate that is adapted to be disposed below a nipple to hold the nipple in position together with a nipple locking cap. The aiding plate has an annular depression located below an air slit of the nipple for receiving air induced via the slit. The annular depression has an air intake hole that extends downwardly to connect to an integrally formed extended air intake tube to guide the air deep into the feeding bottle so as to balance the air pressure inside the bottle. Hence, the air guided into the feeding bottle will avoid the mouth of the nipple where the fluid suction force is strong, and the passages of air and fluid will be separated, thus preventing entry of air into the baby's stomach during feeding.

2 Claims, 3 Drawing Sheets

AIR INTAKE AIDING PLATE FOR NIPPLES OF FEEDING BOTTLES

BACKGROUND OF THE INVENTION (a) Field of the Invention

The present invention relates generally to an air intake aiding plate for nipples of feeding bottles, and more particularly to an air intake aiding plate that is adapted to be fitted below a nipple of a feeding bottle to prevent entry of air into a baby's stomach along with the fluid in the feeding bottle when the baby is being fed.

(b) Description of the Prior Art

It is noted that during the release of fluid from a feeding bottle, since the feeding bottle is enclosed, if a suitable amount of air is not introduced into the feeding bottle from the outside during the sucking process, the pressure inside the feeding bottle will drop, resulting in an imbalance between the pressures inside and outside the feeding bottle, which makes it difficult for the baby to suck up the fluid. Therefore, with reference to FIG. 1A, a lower portion of a nipple 2 is generally provided with a tiny slit 211 for intake of air. After the cap 3 is locked to the mouth of the feeding bottle 4, when the fluid M inside the feeding bottle 4 is being sucked up using the nipple 2, a suitable amount of the ambient air A is automatically drawn into the feeding bottle 4 via the slit 211 to balance and compensate the pressures inside and outside the feeding bottle 4. However, since a fluid sucking region of a strong suction force is naturally formed at the inner portion of the mouth 21 of the nipple 2 during the sucking process, the air A drawn in via the slit 211 at the peripheral portion of the mouth 21 will naturally have a portion thereof sucked up as air A1 due to its being at the periphery of the mouth 21. The air A1 will naturally be sucked up with the fluid M1 into the baby's stomach, making it uncomfortable and unwell, and it will cry aloud from pain. This phenomenon is quite common among babies after feeding.

Referring to FIG. 1B, there is available another type of feeding structure. An automatic straw unit 5 is installed below the nipple 2. A seat plate 51 provided at an upper portion of the automatic straw unit 5 is located below the nipple 2 and has an air intake hole 511 for receiving the air A1 introduced from the slit 211 of the nipple 2 into the inner side of the feeding bottle 4. And the automatic straw unit 5 has an extended soft tube 52 at a lower portion thereof, and the soft tube 52 is provided with a rear end suction head 521 to extend the suction force of the nipple 2 to thereby permit continuous drawing up of fluid M to the top of the nipple 2.

Referring to FIG. 1B, when the soft tube 52 is extended, as shown by the imaginary lines, as the rear end suction head 521 of the straw unit 5 is quite far away from the entry position of the air A1, the above-mentioned problem that babies may suck up air A1 simultaneously with the fluid M1 is avoided.

However, when the baby holds the feeding bottle 4 substantially upside down so that the soft tube 52 of the automatic straw unit 5 drops such that its rear end suction head 521 falls near the mouth of the feeding bottle 4, forming a fluid suction region of a strong suction force at the location of the end of the suction head 521. In this way, a portion of the air A1 drawn in via the slit 211 past the air intake hole 511 of the seat plate 51 will be simultaneously drawn up with the fluid M1 since it is near the suction head 521. And the air A1 is drawn to the inner portion of the nipple 2 and sucked up by the baby with the fluid M, causing discomfort to the baby.

SUMMARY OF THE INVENTION

A primary object of the present invention is to provide an air intake aiding plate structure for nipples of feeding bottles, adapted to be disposed below a nipple and straddle over the mouth of a feeding bottle so as to hold the nipple in position together with a nipple locking cap. The aiding plate is provided to receive ambient air induced into the feeding bottle and guide it through an air intake hole provided in an annular depression thereof and along an air intake tube that is connected directly to a bottom end of the air intake hole and that extends deep into the feeding bottle so that the air is released to a relatively deep portion of the feeding bottle, thereby balancing the air pressure in the bottle. By means of this arrangement, the induced air can avoid passing through a fluid suction region at the mouth of the inner section of the nipple where the suction force is strong, thus preventing entry of air into the baby's stomach along with the fluid in the feeding bottle when the baby is being fed.

Another object of the present invention is to provide an air intake aiding plate structure for nipples of feeding bottles, that is installed below a nipple in a detachable manner so that it can be conveniently removed for washing purposes and re-installed after washing.

A further object of the present invention is to provide an air intake aiding plate structure for nipples of feeding bottles, that is provided with a collar having a central portion that is hollowed downwardly, whereby the aiding plate can be directly fit into the nipple for use. Additionally, the hollowed portion of the collar of the aiding plate can be connected to a securing seat plate that has an extended soft tube and a suction head at a rear end of the soft tube so that the aiding plate can be turned into an automatic straw unit to provide consumers with more variety.

BRIEF DESCRIPTION OF THE DRAWINGS

The foregoing and other features and advantages of the present invention will be more clearly understood from the following detailed description and the accompanying drawings, in which.

FIG. 2A is a perspective assembled view of the first embodiment of the present invention;

FIG. 2B is a perspective assembled view of a second embodiment of the present invention;

FIG. 2C is an exploded view of a suction tube assembly.

FIG. 2D is a perspective assembled view of a third embodiment of the present invention using the suction tube assembly of FIG. 2C.

DETAILED DESCRIPTION OF THE PREFERRED EMBODIMENT

Figure 1B:
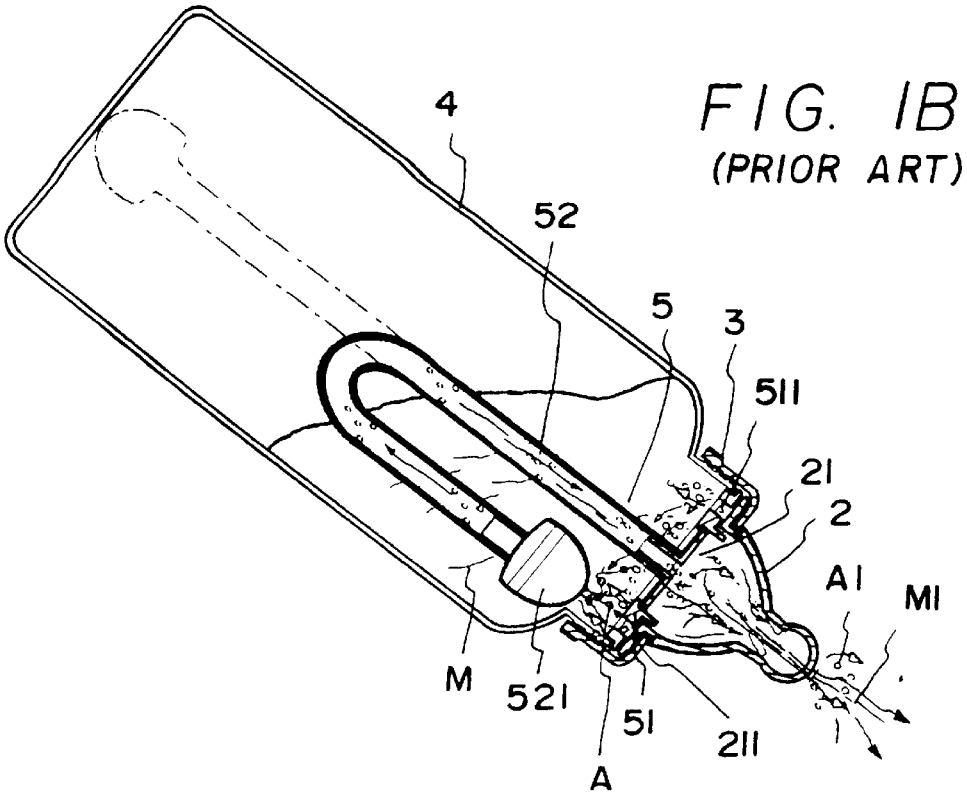
FIG. 1B (PRIOR ART)
FIG. 1B is a schematic view of the conventional nipple adapted for use with an automatic straw unit in a use state.
Figure 1A:
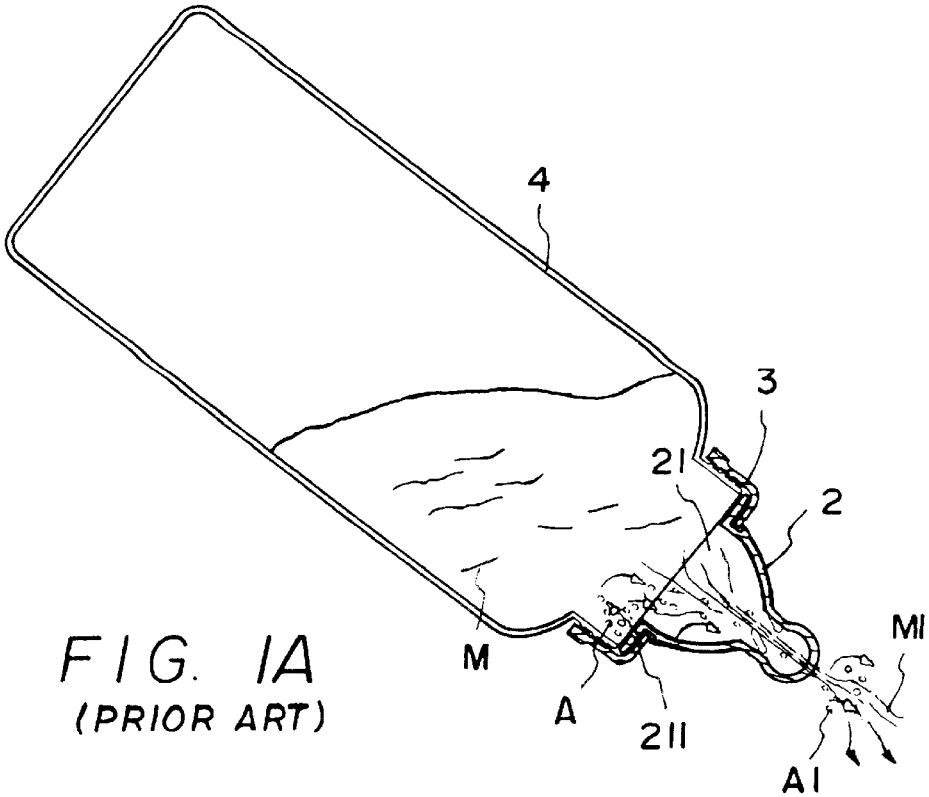
FIG. 1A (PRIOR ART)
FIG. 1A is a schematic view of a conventional nipple in use.
Figure 2:
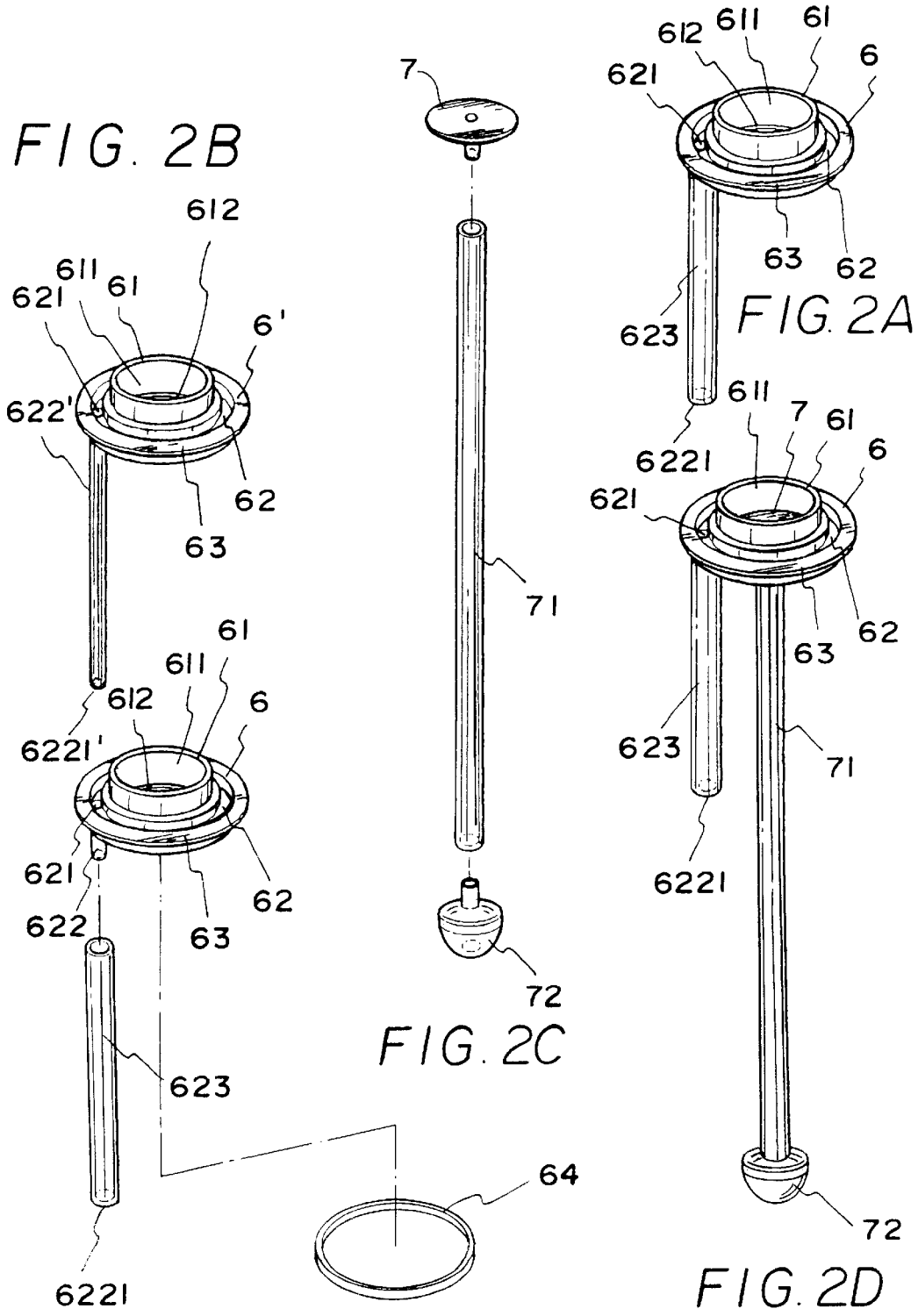
FIG. 2 is a perspective exploded view of a first embodiment of the present invention.
Figure 3B:
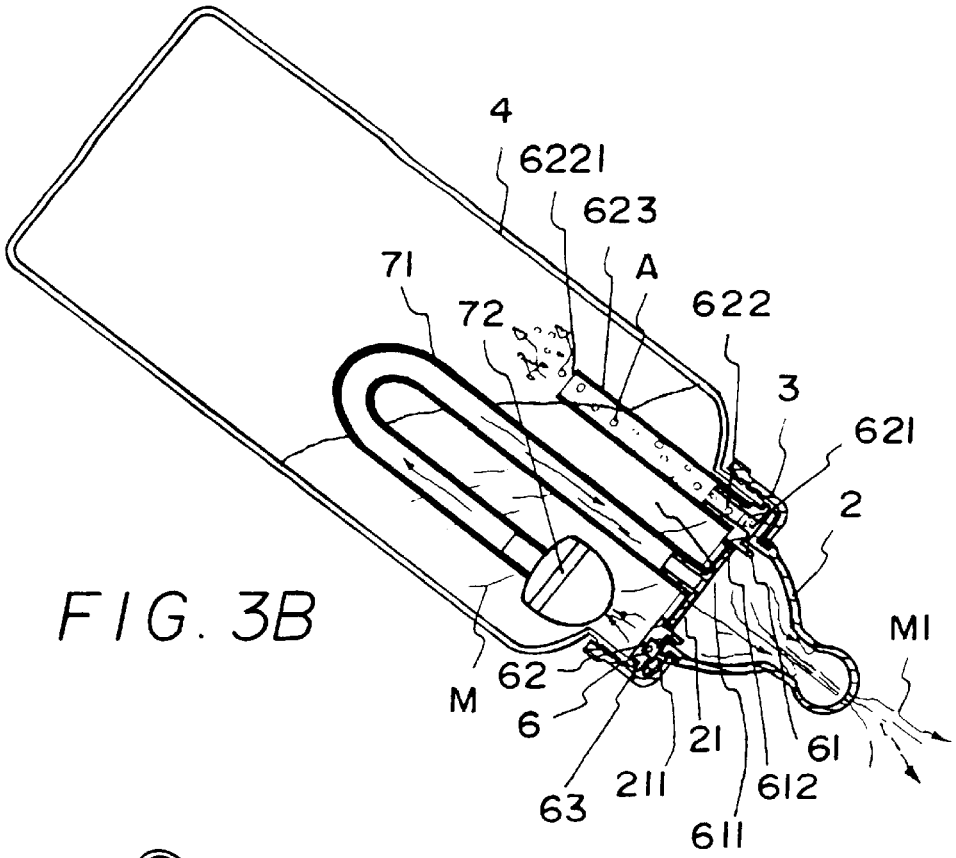
FIG. 3B is a schematic view of the third embodiment of the present invention adapted for use with a nipple and an automatic straw unit.
Figure 3A:
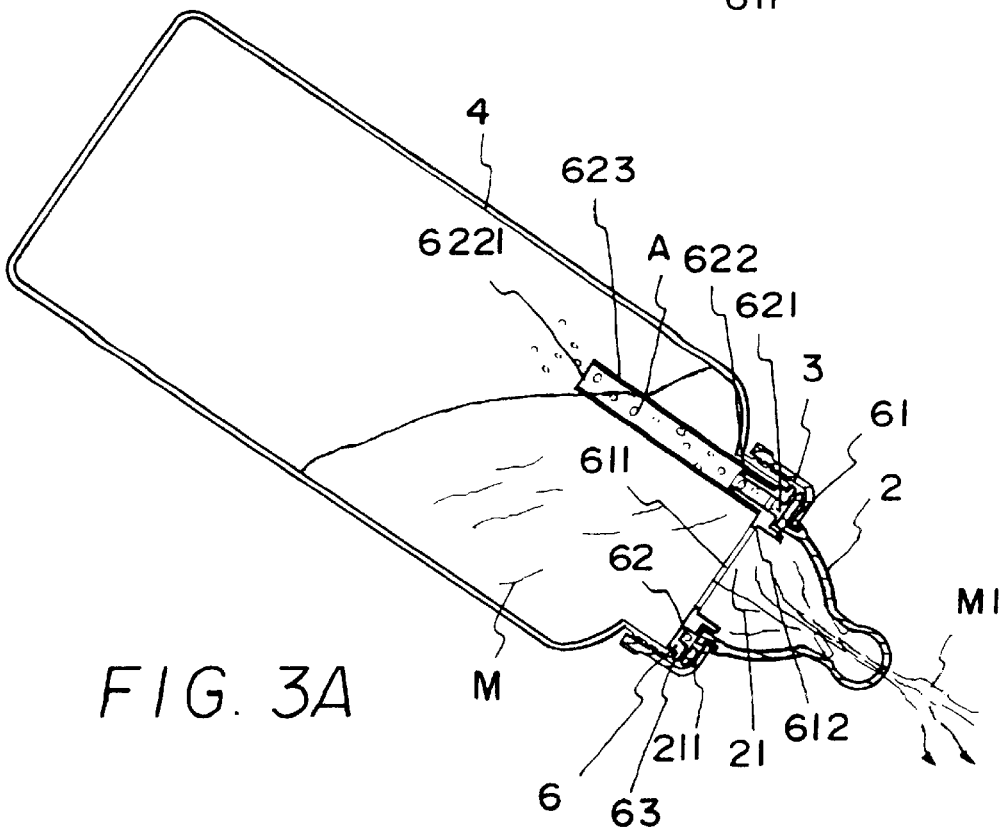
FIG. 3A is a schematic view of the first embodiment of the present invention adapted for use with a nipple.

Referring to FIGS. 2, 2A, and 3A, the present invention essentially comprises an aiding plate 6 that is disposed below a nipple 2 to straddle on the mouth of a feeding bottle 4 so as to cooperate with a nipple locking cap to commonly position the nipple 2. The aiding plate 6 essentially includes a collar 61 that has a raised central section and that is extendable into a fitting hole at a lower section of the nipple 2. The periphery of the collar 61 is provided with an annular depression 62 and a thin stop lip 63 surrounding the annular depression 62. It should be noted that the above-described structure is similar to the seat plate 51 of the automatic straw unit 5 shown in FIG. 1B and is known in the art.

The present invention is characterized in that the central section of the collar 61 is an opening 611 that is hollowed downwardly, and the depression 62 is provided with an air intake hole 621 that extends downwardly. A bottom edge of the intake hole 621 extends directly downwardly to an integrally formed air intake tube 622. By means of the extended intake tube 622' on the alternative upper aiding plate 6' shown in FIG. 2B, or by means of connecting the intake tube 622 to an extension tube 623 (which may be a soft tube), as shown in FIGS. 2 and 2A, an air intake port 6221 or 6221' at the rear end of the intake tube 622 can orient and extend downwardly (rearwardly) to a certain distance deep into the feeding bottle 4.

With reference to FIG. 3A, by means of the above-described construction, when the nipple 2 fitted above the aiding plate 6 is sucked and a suitable amount of air A is drawn in via a slit 211 provided on the nipple 2 to balance the pressure inside the feeding bottle 4 to permit smooth fluid flow, the induced air A may, after entering the depression 62, be guided to the intake end port 6221 deep into the feeding bottle 4 due to the arrangement of the excluded intake tube 622. In this way, the air A may, when the nipple 2 is being sucked, avoid the fluid suction region at the mouth 21 of the nipple 2 where the suction force is strong, and the baby will only suck in the fluid M1 drawn up through the opening 611 of the collar 61, without taking in the air, which may make the baby feel sick.

Referring to FIGS. 2, 2C, 2D and 3B, a bottom portion of an inner section of the opening 611 of the collar 61 of the aiding plate 6 may be provided with a projecting stop rim 612 for receiving a securing seat plate 7 that has an extended soft tube 71 and a suction head 72 at a rear end of the soft tube 71, thereby turning the aiding plate 6 into a dual function air intake aiding plate having the function of an automatic straw unit, as shown in FIG. 2B. According to this structure, when the soft tube 71 is extended (not shown) since the suction head 72 at the rear end of the soft tube 71 is quite far away from the entering position of the ambient air A, the problem that the baby may take in the air A with the fluid M1 is not present. If the baby holds the feeding bottle in an upside down position, since the soft tube 71 is flexible, the suction head 72 will fall to near the mouth of the feeding bottle 4, a fluid suction region generating a strong suction force is formed at the position of the suction head 72. But since it is still quite far away from the intake end port 6221 at the rear end of the intake tube 622 of the aiding plate 6 located deep into the feeding bottle 4, the air A entering the feeding bottle 4 via the intake end port 6221 may also effectively avoid the fluid suction region near the mouth 21 at the inner section of the nipple 2 when the latter is being sucked. Therefore, the baby will only take in the fluid M1 that is sucked up via the suction head 72 through the soft tube 71 to the inner section of the nipple 2, without taking in unnecessary air that will make the baby feel sick, as shown in FIG. 3B.

In addition, elastic packing plates 64 may be respectively fitted at the lower portion of the stop lip 63 of the aiding plates 6 and 6'. The packing plate 64 seals the mouth of the feeding bottle 4 to effectively prevent possible entry of air at the mouth, so that the ambient air can only enter through the intake tube 622.

A further feature of the present invention is that the securing seat plate 7 can be optionally connected to the aiding plate 6 so that it has the function of an automatic straw unit to give consumers more variety in use.

Although the present invention has been illustrated and described with reference to the preferred embodiment thereof, it should be understood that it is in no way limited to the details of such embodiment but is capable of numerous modifications within the scope of the appended claims.

What is claimed is:

1. An air intake aiding plate structure for a nipple of a feeding bottle, adapted to be disposed below a nipple and straddle over an upper portion of a mouth of the feeding bottle together with the nipple, said aiding plate cooperating with a nipple locking cap to commonly hold the nipple in position, said aiding plate comprising a centrally located, raised collar fitting into a lower section of the nipple, said collar having a periphery with an annular depression and a thin stop lip surrounding the annular depression, wherein:

a central section of said collar forms an openings said annular depression has an air intake hole that extends downwardly, a bottom edge of said air intake hole communicating with an air intake tube device having an air intake port extending downwardly into the feeding bottle, whereby ambient air induced via a slit in the nipple is guided into the feeding bottle, avoiding a mouth of the nipple, so that passages of air and fluid in the feeding bottle are separated, thus preventing entry of air into the users stomach when the fluid is being sucked up; said opening of said collar of said aiding plate has a protecting stop rim at a bottom portion of an inner section thereof; and a securing seat plate fitted onto said projecting stop rim, said securing seat plate having a soft tube extending into the feeding bottle through the opening in said collar and a suction head at a rear end of said soft tube, whereby said aiding plate also functions as an automatic straw unit.

2. The air intake aiding plate structure as defined in claim 1, further comprising an elastic packing plate provided at a lower portion of said stop lip, said packing plate sealing the mouth of the feeding bottle so as to prevent entry of air and to ensure entry of air into the feeding bottle through said air intake tube.

* * * * *